US010112754B2

(12) United States Patent
Roucou

(10) Patent No.: US 10,112,754 B2
(45) Date of Patent: Oct. 30, 2018

(54) BOTTLE INCLUDING A SAFETY CORKING

(71) Applicant: Pernod Ricard, Paris (FR)

(72) Inventor: Jean-Francois Roucou, Rueil-Malmaison (FR)

(73) Assignee: Pernod Ricard, Paris (FR)

( * ) Notice: Subject to any disclaimer, the term of this patent is extended or adjusted under 35 U.S.C. 154(b) by 0 days.

(21) Appl. No.: 15/844,747

(22) Filed: Dec. 18, 2017

(65) Prior Publication Data

US 2018/0105335 A1 Apr. 19, 2018

Related U.S. Application Data

(63) Continuation of application No. PCT/FR2016/051530, filed on Jun. 22, 2016.

(30) Foreign Application Priority Data

Jun. 22, 2015 (FR) ..... 15 55703

(51) Int. Cl.
*B65D 55/02* (2006.01)
*B65D 41/62* (2006.01)
(Continued)

(52) U.S. Cl.
CPC ..... *B65D 55/026* (2013.01); *B65D 39/0005* (2013.01); *B65D 41/62* (2013.01);
(Continued)

(58) Field of Classification Search
CPC .. B65D 55/026; B65D 39/0005; B65D 41/62; B65D 55/06; B65D 55/0854; B65D 2203/02; B65D 2203/10
(Continued)

(56) References Cited

U.S. PATENT DOCUMENTS 2,079,757 A 5/1937 Berk
2,361,464 A 10/1944 Edwards et al.
(Continued)

FOREIGN PATENT DOCUMENTS

CN 205221458 5/2016
EP 0105971 4/1984
(Continued)

OTHER PUBLICATIONS

International Search Report for PCT/FR2016/050513 dated Oct. 6, 2016.

*Primary Examiner* — Daniel A Hess
(74) *Attorney, Agent, or Firm* — Burris Law, PLLC

(57) ABSTRACT

The present disclosure provides a bottle that includes a body having a neck at a top end. The neck of the bottle ends in an aperture for receiving a cork/plug. The bottle further includes a security closure that includes a security label having a first portion adhered to the cork and a second portion adhered onto the neck of the bottle. A cap at least partially covers the cork and the neck of the bottle. The cap partially covers the security label. The security label further includes: a bottom portion that extends beyond a bottom edge of the cap and carries a first readable code representing a unique identifier of the bottle; and a top portion that is covered by the cap and adhered to the cork, and carries a second readable code representing a unique identifier of the cork/plug.

20 Claims, 5 Drawing Sheets

Figure 1:
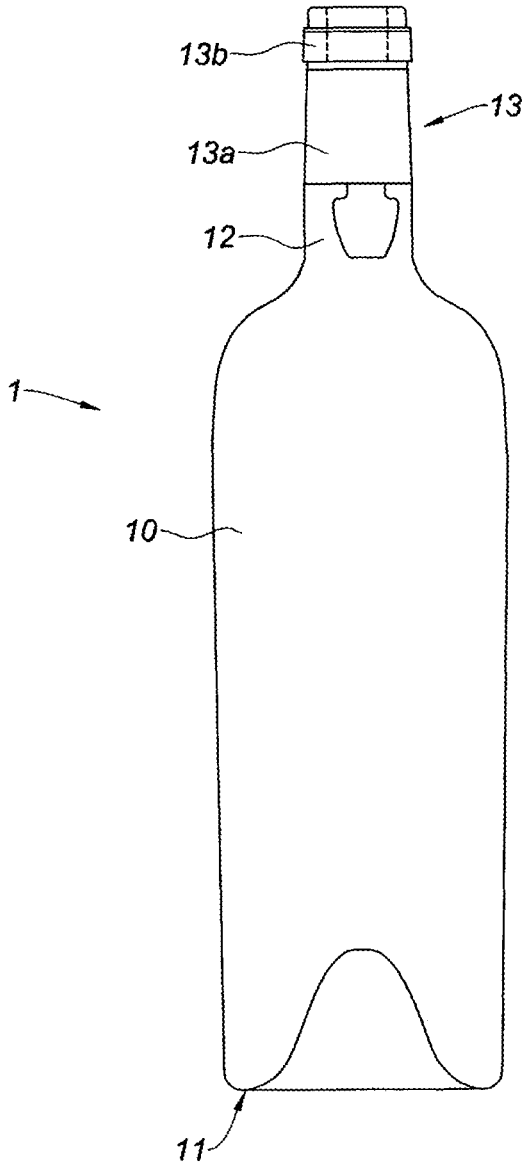

(51) Int. Cl.
*B65D 55/06* (2006.01)
*B65D 55/08* (2006.01)
*B65D 39/00* (2006.01)

(52) U.S. Cl.
CPC ..... *B65D 55/06* (2013.01); *B65D 55/0854* (2013.01); *B65D 2203/02* (2013.01); *B65D 2203/10* (2013.01)

(58) Field of Classification Search
USPC ..... 235/375
See application file for complete search history.

(56) References Cited

U.S. PATENT DOCUMENTS

2005/0162277 A1 7/2005 Teplitxky et al.
2007/0296599 A1* 12/2007 Wang ..... B65D 55/028 340/572.8
2008/0140432 A1* 6/2008 Fenn ..... G06O 10/087 705/317
2009/0045959 A1* 2/2009 Adstedt ..... B65D 55/028 340/572.3
2009/0212954 A1* 8/2009 Adstedt ..... B65D 39/00 340/572.8
2009/0267729 A1 10/2009 Rowe et al.
2016/0063830 A1* 3/2016 Glamuzina, Jr. .. G08B 13/2428 340/572.1

FOREIGN PATENT DOCUMENTS

FR 2998881 6/2014
WO 1993/012513 6/1993
WO 2010/063909 6/2010
WO 2014/129485 8/2014
WO 2015/177448 11/2015

* cited by examiner

BOTTLE INCLUDING A SAFETY CORKING

CROSS-REFERENCE TO RELATED APPLICATIONS

This application is a continuation of International Application No. PCT/FR2016/051530, filed on Jun. 22, 2016, which claims priority to and the benefit of FR 15/55703 filed on Jun. 22, 2015. The disclosures of the above applications are incorporated herein by reference.

FIELD

The present disclosure relates to the field of beverage containers, and more particularly to a bottle intended to contain a beverage, in particular an alcoholic beverage.

BACKGROUND

The statements in this section merely provide background information related to the present disclosure and may not constitute prior art.

The production and marketing costs of high-quality alcoholic beverages, such as spirits, result in high sale prices. These high prices generate, as is often for luxury goods, fraud as well as acts of counterfeiting. Thus, there is regularly observed the apparition on the market of counterfeit bottles, that is to say having the external apparition of an authentic bottle, but filled with a bad quality beverage, much less than the quality of the original product. This phenomenon of counterfeiting is in particular important for high quality spirits, such as cognac for example.

For economic, safety and brand image reasons, the concerned producers are vigorously fighting against these acts of fraud and counterfeiting. This fight results in particular in the manufacture of bottles including increasingly advanced anti-counterfeiting devices, aimed at preventing the exact reproduction of a bottle and/or its reuse. Many solutions have been proposed for this purpose. These solutions generally consist in using secure plugs, the manufacture of which is expensive and complex.

SUMMARY

The present disclosure provides an anti-counterfeiting device for a bottle which has an improved safety level, and which is simple and inexpensive to implement. The present disclosure further provides information to the consumer before opening the bottle, in particular for the purpose of allowing the authentication of the bottle by the consumer.

To this end, the present disclosure concerns a bottle intended to contain a beverage, such as an alcoholic beverage, said bottle including a body whose upper end includes a neck, the neck of the bottle ending with a mouth and receiving a plug, the bottle being provided with a safety corking, said safety corking including:

a security label whose first part is adhered to the plug and whose second part is adhered to the neck of the bottle; and a cover covering at least partially the plug and at least one part of the neck of the bottle, said cover also covering at least one part of the security label.

The security label further includes:

a lower portion projecting from a lower edge of the cover, and bearing a first code, for example an optically readable code, the first code being representative of a unique identifier of the bottle, and an upper portion, covered by the cover, adhered to the plug, and bearing a second code, for example an optically readable code, the second code being representative of a unique identifier of the plug.

Thus, by providing a security label disposed under the cover of the bottle, the security label is protected and the access to said security label involves unsealing the cap. In an advantageous form of the present disclosure, the cover is adhered to the bottle, which provides an additional protection. Furthermore, the present disclosure has the advantage of being adapted to any type of bottles and plugs, without modification. In an advantageous form of the present disclosure, the presence of the first and second codes allow certainly authenticating a bottle, and, also, providing that its content cannot be modified or exchanged fraudulently. Indeed, when these codes correspond respectively to a unique identifier of the bottle and to a unique identifier of the plug, these two codes may be associated in a database updated by the producer of the beverage. The checking, by the consumer, of the correspondence between the first and second codes allows authenticating the concerned bottle. The arrangement of the second code, masked under the cover and consequently invisible before the tearing of the cover prior to the first opening of the bottle, allows increasing the safety of the corking and limiting any possibility of fraud. Furthermore, when the second code is representative of a unique identifier of the plug, the reconstitution of fraudulent bottles with recovery plugs is inhibited.

In one form of the present disclosure, the top portion is adhered to an upper surface of the plug.

In another form, the upper portion is adhered to a lateral surface of the plug.

In another form, at least one portion of the security label is definitively modified in case of detachment, for example by a color change.

In another form, the cover is a metal cap adhered to the neck of the bottle in one form by a safety adhesive.

In another form, the cover is made of a shrinkable sleeve, in particular a sleeve made of a heat-shrinkable plastic material.

In another form, the shrinkable sleeve is adhered to the neck of the bottle in one form by a safety adhesive.

In another form, the security label includes in the vicinity of the mouth a pre-rupture area, such as a precut line.

In another form, a marking is etched at the interface between the cover and the neck of the bottle, such that a part of said marking is etched in the cover, the other part being etched in the bottle.

In another form, the marking is etched by a laser.

In another form, the first code remains readable even after detachment of the lower portion of the security label.

In another form, the second code remains readable even after detachment of the upper portion of the security label.

In another form, the first and/or the second code(s) is(are) a two-dimensional optically readable code(s), for example a QR type code or a Datamatrix type code.

In another form, the security label includes a radio frequency identification system.

In another form, the radio frequency identification system includes an electronic chip and an antenna, the antenna being arranged such that the first opening of the plug causes the rupture of the antenna.

The present disclosure also concerns a checking system of the authenticity of a bottle containing a drink, said bottle being as defined above, the system including a server including a database, the database including data relating to the manufactured bottles, these data including in particular, for each bottle, a unique identifier of the bottle and a unique identifier of the plug associated to this bottle In one form, the database included in the server is remotely accessible, for example from a portable apparatus, such as a mobile phone, the server being configured to transmit data relating to a bottle in response to a request including the first corresponding to said bottle.

In another form, the server is configured to transmit data allowing confirming the authenticity of a bottle, in response to a request including the first and second codes of said bottle.

Further areas of applicability will become apparent from the description provided herein. It should be understood that the description and specific examples are intended for purposes of illustration only and are not intended to limit the scope of the present disclosure.

DRAWINGS

Figure 2A:
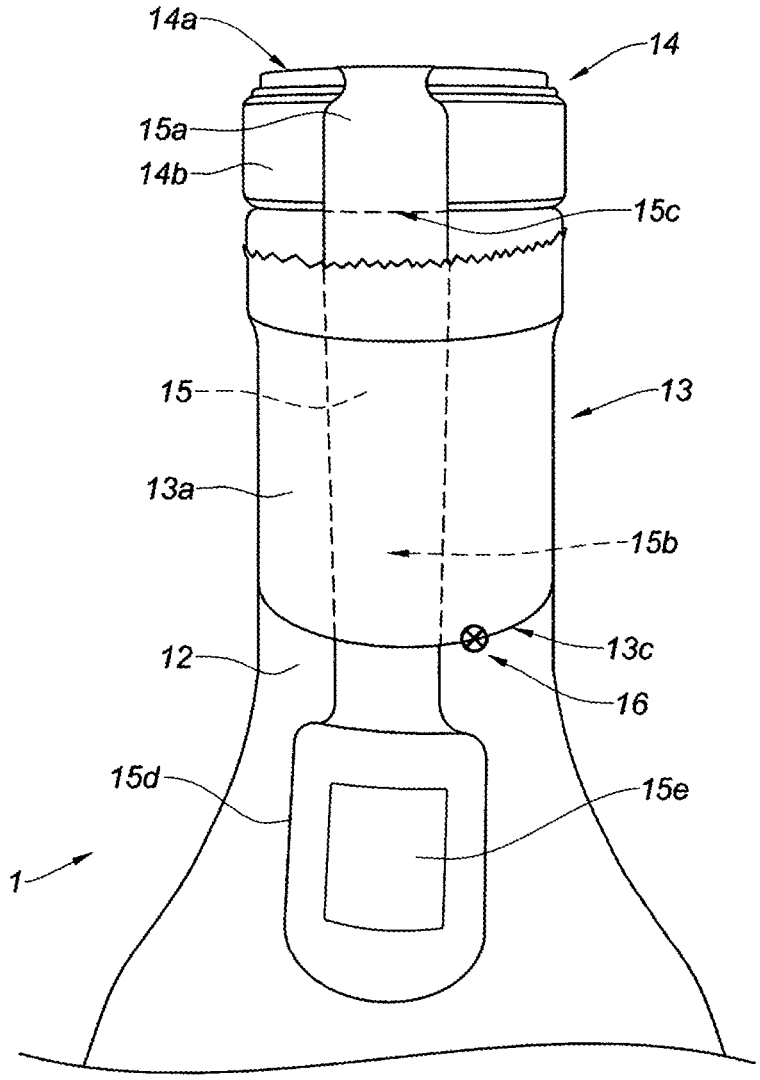
Figure 2B:
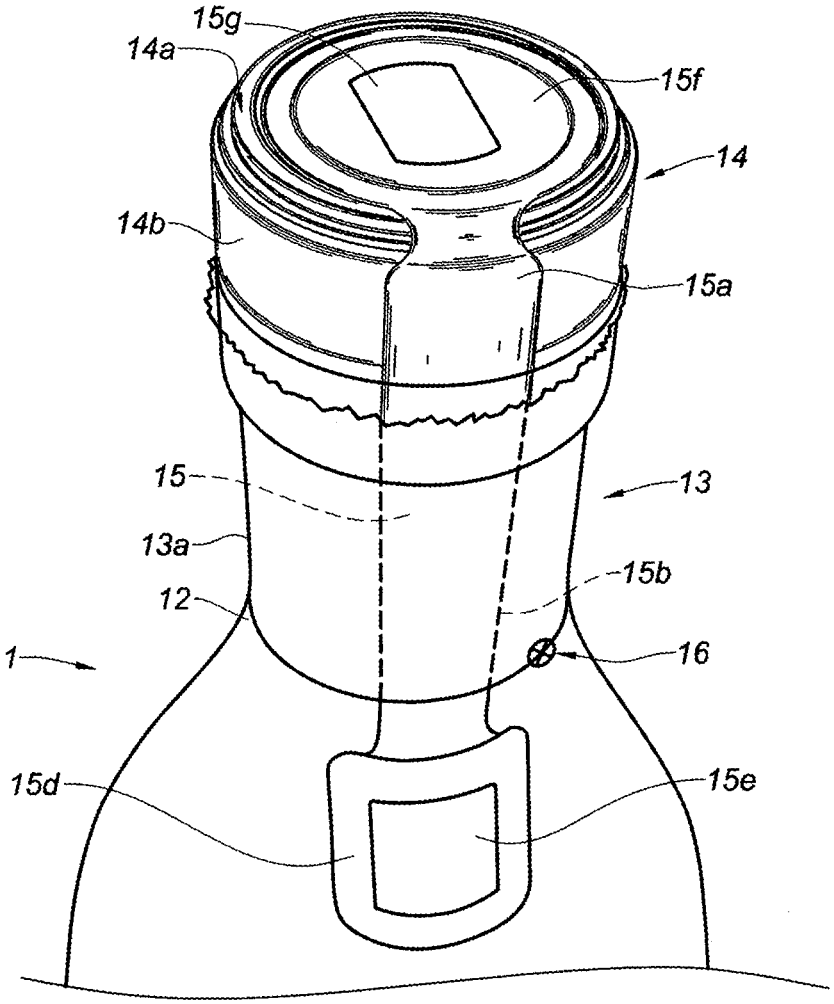
Figure 3:
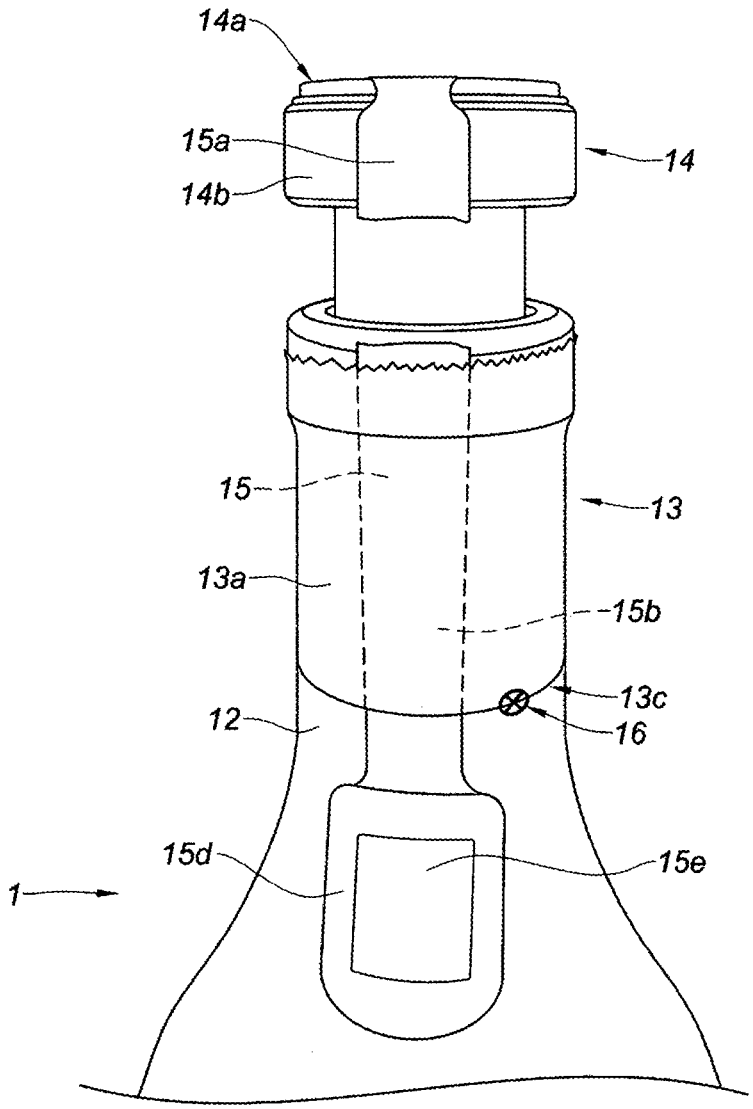
Figure 4:
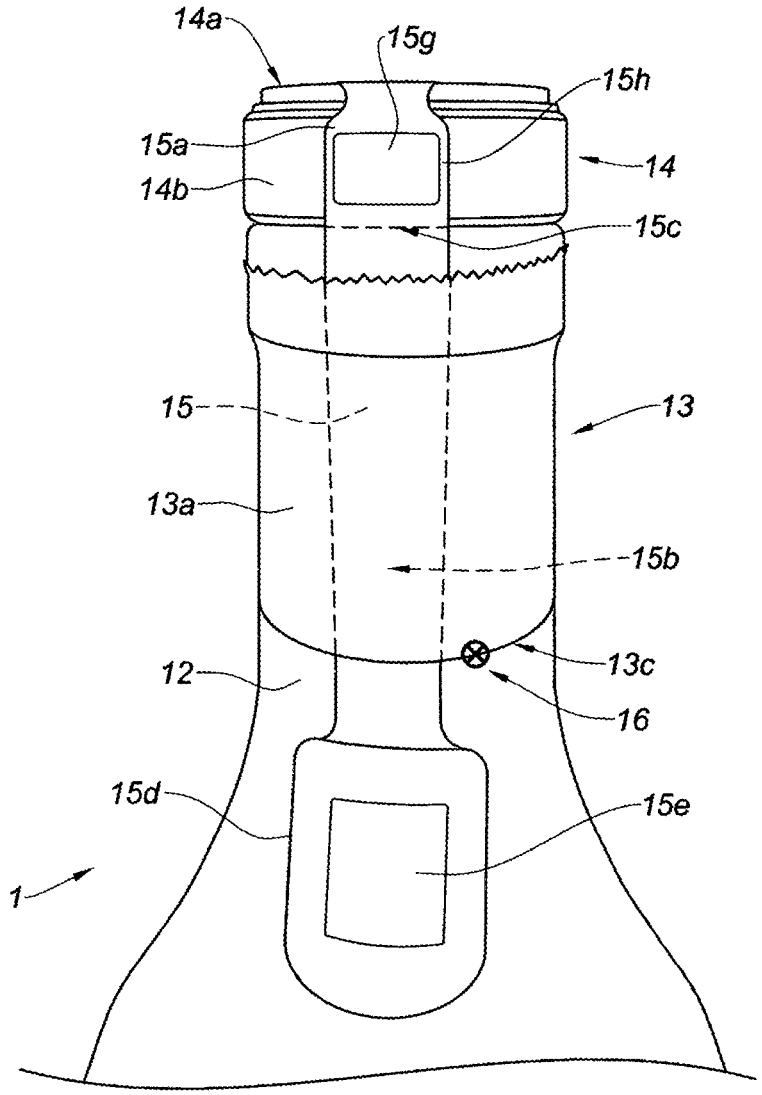

In order that the disclosure may be well understood, there will now be described various forms thereof, given by way of example, reference being made to the accompanying drawings, in which:

FIG. 1 shows a bottle in accordance with the teachings of the present disclosure;

FIG. 2*a* is a partial side view of the bottle of FIG. 1 after removal of an upper part of a cover and before a first opening of a plug;

FIG. 2*b* is a partial top perspective view of the bottle of FIG. 1 after removal of an upper part of a cover and before a first opening of a plug;

FIG. 3 is a partial side view of the bottle of FIG. 1 after a first opening of a plug; and FIG. 4 is a partial side view of a variant of a bottle according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a bottle 1 in accordance with the present disclosure. The bottle 1, for example a glass bottle, is adapted to receive all types of beverage, and more particularly alcoholic beverages such as wines or spirits. It is shown in FIG. 1 as put on the market, that is to say prior to any opening by a consumer.

Conventionally, the bottle 1 includes a body 10, whose lower part ends with a bottom 11, and whose upper part ends with a neck 12. The neck 12 includes, in the upper part, an opening closed by a plug 14 (FIG. 2), the assembly of the neck 12 and the plug 14 being covered by a cover 13, in the example, a metallic cap 13. The cap 13 includes a lower portion 13*a* and an upper portion 13*b*. The upper portion 13*b* of the cap 13 should be, during the first use, separated from the bottle 1 to access the plug 14. This separation is generally performed by tearing, and to this end, the cap 13 may include a device for facilitating the tearing thereof, for example a tear strip.

According to the present disclosure, the bottle 1 of FIG. 1 includes a safety corking, providing in particular the function of a tamperproof seal. The safety corking in accordance with the present disclosure includes in particular a security label 15, allowing detecting whether the bottle has already been opened a first time. In FIG. 1, which shows the bottle 1 before unsealing the cap 13, only a lower part of the security label 15, projecting from the lower edge of the cap 13, is visible.

The security label 15 is better shown in FIGS. 2*a*, 2*b*, and 3, which show a partial view of the bottle of FIG. 1, the upper part 13*a* of the cap 13 having been removed. Thus, FIGS. 2*a* and 2*b* show the plug 14, which includes an upper surface 14*a* and a lateral surface 14*b*. In FIGS. 2*a* and 2*b*, the plug 14 has not been removed. Therefore, these two figures show a security label 15, in the example in the form of a tape. This security label 15 includes a first part 15*a* fastened to the plug 14 and a second part 15*b* fastened to the neck 12 of the bottle 1. The fastening of the security label 15 is made by gluing, said security label 15 being self-adhesive in one form. Between the first part 15*a* and the second part 15*b*, the security label 15 includes a pre-rupture area 15*c*, constituted for example by a precut line. Thus, this pre-rupture area 15*c* has a fragility greater than the rest of the security label 15 and provides that the security label 15 is easily breakable at this location.

As shown in FIG. 3, which shows the bottle 1 of FIG. 1 after a first opening of the plug 14, the first opening of the plug 14 leads to the rupture of the security label 15, precisely at the rupture area 15*c*. Thus, this rupture constitutes a visual indication that the plug 14 has already been removed a first time, and therefore that the bottle 1 has already been opened.

To provide a security label 15 that is totally secure, said security label 15 is of the non-reusable type, in particular for the purpose of inhibiting the security label 15 from being transferred intact on a bottle other than the original one. Thus, any attempt of detachment will result in altering the security label 15, for example by the disintegration of said security label 15. In the example, at least one portion of the security label 15 is to this end definitively destructible and/or modifiable, for example by delamination. Thus, it will be possible to expect that at least one portion of the security label 15 is permanently modified in case of detachment, for example by a color change. This modification will remain visible in case of later adhesion, even if the security label 15 is re-adhered to the same bottle, in its initial position. In case of re-adhering on another support, the modification will of course remain visible, thus allowing visually warning that the security label 15 has been transferred after manufacturing the bottle 1. Advantageously, the security label 15 will comprise portions accordingly modifiable on either side of the pre-rupture area 15*c*. Thus, the security label 15 will allow detecting the attempts to access the plug 14 by detachment of the security label 15, whether by detachment of the first part 15*a*, fastened by gluing to the plug 14, or by detachment of the second part 15*b* of the security label 15, fastened by gluing to the neck 12 of the bottle 1.

To reinforce the safety offered by the security label 15, the cap 13 is, in accordance with the present disclosure, disposed over the security label 15. It is advantageous that the cap 13, in particular when it is metallic, is adhered to the bottle 1, for example by a safety adhesive. The safety adhesive will inhibit the possibility to remove the cap 13 without harming its entirety. Advantageously, the safety adhesive will be arranged in the form of one or more ring(s) along the perimeter of the neck of the bottle. In this case, a portion of the safety adhesive will be disposed on the security label, thereby bonding a part of the cap to the security label.

Instead of a metal cap, it is possible to provide a sleeve made of a heat-shrinkable plastic material. This heat-shrinkable sleeve may be also adhered to the bottle by a safety adhesive, in a similar manner to that described above.

It has been seen that the fact that the security label 15 is covered, and therefore protected, by the cap 13, has great advantages. However, to further reinforce the protection of the bottle against fraud, it is advantageous that one part of the security label 15 is visible even without opening the cap 13. In the example, the security label 15 projects from the lower edge 13*c* of the cap 13 and is therefore visible. The second part 15*b* of the security label 15 ends at its lower end with a lower portion 15*d*. In the example, the lower portion 15*d* forms an enlarged area relative to the rest of the security label 15. This lower portion 15*d* may thus serve to display a first optically readable code 15*e* (such as a QR code, a Datamatrix code, or a bar code), and/or an alphanumeric code readable by a consumer. The lower portion 15*d* projecting from the lower edge 13*c* of the cap, the first code 15*e* will be visible in all circumstances, and in particular without the need to remove the cap 13. The first code 15*e* might advantageously be representative of a unique identifier of the bottle. Thus, this code may be read by a consumer, including before the purchase of the bottle. The first code 15*e* might be advantageously read by a portable apparatus (typically a mobile phone), and accordingly be automatically checked by connection to a remote server, this server including a database whose data are made available by the producer of the beverage. Information of the database returned by the server might comprise: the product brand; its type; and the date of bottling, etc. This information might be accordingly compared by the consumer with said information shown on the label of the bottle. This in situ checking constitutes an additional level of safety.

Advantageously, the lower portion 15*d* will, as the rest of the security label 15, be definitively alterable and/or modifiable (for example by delamination) in case of detachment. However, unlike the rest of the security label 15, the lower portion 15*d* will be configured so that in case of detachment and definitive alteration and/or modification, in particular by delamination, the first code 15*e* remains readable.

As shown in FIG. 2*b*, the first part 15*a* of the security label 15 bears a second code 15*g*, arranged such that said second code 15*g* remains invisible before the removal of the cover 13. The first part 15*a* of the security label 15 might for this purpose include, at its upper end, an upper portion 15*f* extending at the upper surface 14*a* of the plug 14, and being adhered to this upper surface 14*a*. This upper portion 15*f* bears, in the example of FIG. 2*b*, the second code 15*g*, which is optically readable (in particular a QR or Datamatrix type code, or a bar code), or of alphanumeric type (directly readable by the consumer), or of graphic pattern type. As well as for the lower portion 15*d*, the upper portion 15*f* will be definitively alterable and/or modifiable (for example by delamination) in case of detachment, such that, if necessary, the optically readable code 15*g* remains readable. The second code 15*g* will advantageously be representative of a unique identifier of the plug 14. The second code being disposed at the surface of the plug 14, it remains masked and invisible as long as the top part of the cap 13 has not been removed. This masked code, representative of a unique identifier of the plug 14, constitutes an additional safety level.

In a variant shown in FIG. 4, the second code 15*g* may be disposed on an upper portion 15*h* of the security label 15, which corresponds to the portion facing the lateral surface 14*b* of the plug 14. This configuration has in particular the advantage of providing a code that is not visible under the cover 13 when said cover does not fully cover the upper surface 14*a* of the plug 14 (for example in case where the cover 13 is a heat-shrinkable sleeve).

The security label 15 including the first and second codes 15*e*, 15*g*, one located on the lower portion 15*d* and the other located on the upper portion 15*f*, the two codes 15*e*, 15*g* are advantageously associated in the aforementioned database. The association of the two codes 15*e*, 15*g* might be used to check the authenticity of the concerned bottle. Indeed, the consumer, who will have been able to check the authenticity of the bottle by transmission of the first code 15*e* (representative of a unique identifier of the bottle) to the server, will be able, after removing the cap 13, to transmit to the server the second code 15*g* (representative of a unique identifier of the plug). After checking the correspondence between the first and second codes 15*e*, 15*g* stored in the database (and therefore of the correspondence between the bottle and the plug), the server might return information confirming the authenticity of the bottle, and, consequently, because its contents could not be changed or modified.

Additionally, or alternatively to one or more of the aforementioned optically readable code(s) 15, it might be expected that the security label 15 includes a radio frequency identification system, of the RFID type ("Radio Frequency Identification"). The information stored in the identification system comprises, in particular, a unique identifier of the bottle. The radio frequency identification system, in particular, comprises an electronic chip and an antenna. Advantageously, it is possible to expect that the antenna is disposed along the security label 15, such that the first opening of the plug of the bottle causes the rupture of the antenna. Thus, the first opening of the plug will make the reading of the electronic chip impossible, the impossibility of the reading indicating that the bottle has already been opened.

In order to further enhance the safety level offered by the bottle of FIG. 1, it is possible to provide a common marking of the bottle 1 and of the cap 13, for example by laser etching. As shown in FIGS. 2*a*, 2*b* and 3, this marking, constituted in the example by a pattern 16, is carried out such that a part of the marking is etched in the cap 13, in the vicinity of, the lower edge 13*c* thereof, the other part of the marking being etched in the neck 12 of the bottle 1. The size and the delicacy of the marking will advantageously be selected such that removing and repositioning the cap 13 such that the two marking parts coincide will be extremely complex or even impossible. The common marking might include a pattern (as shown in the figures) or of a sequence of alphanumeric characters, or a combination of the two.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A bottle containing a beverage, such as an alcoholic beverage, said bottle comprising:

a body having a neck on an upper end, the neck of the bottle ending with a mouth for receiving a plug; and a safety corking comprising:

a security label having a first part adhered to the plug and a second part adhered on the neck of the bottle; and a cover covering at least partially the plug and at least one part of the neck of the bottle, said cover further covering at least one part of the security label;

wherein the security label further includes:

a lower portion projecting from a lower edge of the cover and bearing a first readable code representing a unique identifier of the bottle; and an upper portion covered by the cover, the upper portion being adhered to the plug and bearing a second readable code representing a unique identifier of the plug.

2. The bottle according to claim 1, wherein the upper portion of the security label is adhered to an upper surface of the plug.

3. The bottle according to claim 1, wherein the upper portion of the security label is adhered to a lateral surface of the plug.

4. The bottle according to claim 1, wherein at least one portion of the security label is modified by a color change when the security label is detached.

5. The bottle according to claim 1, wherein the cover is a metallic cap adhered to the neck of the bottle with a safety adhesive.

6. The bottle according to claim 1, wherein the cover is made of a shrinkable sleeve made of a heat-shrinkable plastic material.

7. The bottle according to claim 6, wherein the shrinkable sleeve is adhered to the neck of the bottle with a safety adhesive.

8. The bottle according to claim 1, wherein the security label further includes a pre-rupture area proximate the mouth of the bottle, wherein the pre-rupture area is a precut line.

9. The bottle according to claim 1, wherein a marking is etched at the interface between the cover and the neck of the bottle, such that a part of said marking is etched in the cover, the other part being etched in the bottle.

10. The bottle according to claim 9, wherein the marking is etched by a laser.

11. The bottle according to claim 1, wherein the first readable code remains readable even after detachment of the lower portion of the security label.

12. The bottle according to claim 1, wherein the second readable code remains readable even after detachment of the upper portion of the security label.

13. The bottle according to claim 1, wherein at least one of the first readable code and the second readable code is a two-dimensional optically readable code.

14. The bottle according to claim 13, wherein the two-dimensional optically readable code is a QR code or a Datamatrix code.

15. The bottle according to claim 1, wherein the security label includes a radio frequency identification system.

16. The bottle according to claim 15, wherein the radio frequency identification system includes an electronic chip and an antenna, the antenna being arranged such that the first opening of the plug causes the rupture of the antenna.

17. A checking system to check authenticity of the bottle according to claim 1, the checking system comprising: a server including a database, the database including data relating to, for each bottle, a unique identifier of the bottle and a unique identifier of the plug associated to the bottle.

18. The system according to claim 17, wherein the database of the server is remotely accessible and the server is configured to transmit data relating to the bottle in response to a request including the first readable code corresponding to said bottle.

19. The system according to claim 18, wherein the database is remotely accessible from a portable apparatus.

20. The system according to claim 17, wherein the server is configured to transmit data confirming the authenticity of the bottle in response to a request including the first and second readable codes of said bottle.

* * * * *